US012595543B2

(12) United States Patent
Hiyama et al.

(10) Patent No.: US 12,595,543 B2
(45) Date of Patent: Apr. 7, 2026

(54) STEEL-SHEET NON-PLATING DEFECT PREDICTION METHOD, STEEL-SHEET DEFECT REDUCTION METHOD, HOT-DIP GALVANIZED STEEL SHEET MANUFACTURING METHOD, AND STEEL-SHEET NON-PLATING DEFECT PREDICTION MODEL GENERATION METHOD

(71) Applicant: JFE STEEL CORPORATION, Tokyo (JP)

(72) Inventors: Maiko Hiyama, Tokyo (JP); Hideyuki Takahashi, Tokyo (JP); Gentaro Takeda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 67 days.

(21) Appl. No.: 18/289,266

(22) PCT Filed: Mar. 25, 2022

(86) PCT No.: PCT/JP2022/014441
§ 371 (c)(1),
(2) Date: Nov. 2, 2023

(87) PCT Pub. No.: WO2022/270092
PCT Pub. Date: Dec. 29, 2022

(65) Prior Publication Data

US 2024/0254612 A1 Aug. 1, 2024

(30) Foreign Application Priority Data

Jun. 25, 2021 (JP) ..... 2021-105400

(51) Int. Cl.
*C23C 2/00* (2006.01)
*C23C 2/20* (2006.01)
*C23C 2/40* (2006.01)

(52) U.S. Cl.
CPC ..... *C23C 2/50* (2022.08); *C23C 2/004* (2022.08); *C23C 2/20* (2013.01); *C23C 2/40* (2013.01)

(58) Field of Classification Search
None
See application file for complete search history.

(56) References Cited

U.S. PATENT DOCUMENTS

2015/0167113 A1* 6/2015 Takahashi ..... C21D 1/26 148/533
2018/0105916 A1 4/2018 Takahashi
(Continued)

FOREIGN PATENT DOCUMENTS

CN 107532269 A 1/2018
EP 4 183 495 A1 5/2023
(Continued)

OTHER PUBLICATIONS

Oct. 2, 2024 extended Search Report issued in European Patent Application No. 22828011.1.
(Continued)

*Primary Examiner* — Alexander M Weddle
(74) *Attorney, Agent, or Firm* — Oliff PLC

(57) ABSTRACT

A steel-sheet non-plating defect prediction method in manufacturing equipment of a hot-dip galvanized steel sheet which equipment includes an annealing furnace, and a plating device arranged on a downstream side of the annealing furnace, the method includes: predicting steel-sheet non-plating defect information on an exit side of the manufacturing equipment by using a non-plating defect prediction
(Continued)

model which is learned by machine learning, the non-plating defect prediction model for which an input data is data including one or two or more parameters selected from attribute information of a steel sheet charged into the manufacturing equipment, one or two or more operational parameters selected from operational parameters of the annealing furnace, and one or two or more operational parameters selected from operational parameters of the plating device, and an output data is non-plating defect information of the steel sheet on the exit side of the manufacturing equipment.

7 Claims, 7 Drawing Sheets

(56) References Cited

U.S. PATENT DOCUMENTS

| | | | |
|---|---|---|---|
| 2020/0377964 | A1 | 12/2020 | Takeda et al. |
| 2022/0091597 | A1 | 3/2022 | Koseki et al. |
| 2022/0261520 | A1 | 8/2022 | Shigemori |
| 2023/0323503 | A1 | 10/2023 | Ojima et al. |

FOREIGN PATENT DOCUMENTS

| | | | | |
|---|---|---|---|---|
| JP | H06-73414 | A | | 3/1994 |
| JP | H08-337858 | A | | 12/1996 |
| JP | 2000-273603 | A | | 10/2000 |
| JP | 4507681 | B2 | | 7/2010 |
| JP | 2014-40656 | A | | 3/2014 |
| JP | 5834775 | B2 | | 12/2015 |
| JP | 2016-17192 | A | | 2/2016 |
| JP | 2016-204744 | A | | 12/2016 |
| JP | 2019074969 | A | * | 5/2019 |
| JP | 6607339 | B1 | | 11/2019 |
| JP | 2021-030300 | A | | 3/2021 |
| WO | 2020/149198 | A1 | | 7/2020 |
| WO | 2021/014804 | A1 | | 1/2021 |

OTHER PUBLICATIONS

Jun. 7, 2022 Search Report issued in International Patent Application No. PCT/JP2022/014441.

Oct. 15, 2025 Office Action issued in Chinese Patent Application No. 202280043899.8.

* cited by examiner

STEEL-SHEET NON-PLATING DEFECT PREDICTION METHOD, STEEL-SHEET DEFECT REDUCTION METHOD, HOT-DIP GALVANIZED STEEL SHEET MANUFACTURING METHOD, AND STEEL-SHEET NON-PLATING DEFECT PREDICTION MODEL GENERATION METHOD

FIELD

The present invention relates to a steel-sheet non-plating defect prediction method, a steel-sheet defect reduction method, a hot-dip galvanized steel sheet manufacturing method, and a steel-sheet non-plating defect prediction model generation method.

BACKGROUND

In recent years, in fields of automobiles, home electric appliances, building materials, and the like, there is an increasing demand for a high-tensile steel sheet (high-tensile steel sheet) that contribute to weight reduction of a structure, and the like. As the high-tensile steel sheet, for example, it is known that a steel sheet having good hole expandability can be manufactured by containing of Si in steel, or a steel sheet in which retained γ is likely to be formed and which has good ductility can be manufactured by containing of Si or Al. However, in a case where a hot-dip galvanized steel sheet is manufactured by utilization of a high-tensile steel sheet containing a large amount (specifically, 0.2 mass % or more) of Si as a base material, there are the following problems.

That is, heat annealing of the steel sheet of the base material is performed at a temperature of about 600 to 900° C. in a reducing atmosphere or a non-oxidizing atmosphere, and then a hot-dip galvanizing treatment is performed on a steel sheet surface, whereby a hot-dip galvanized steel sheet is manufactured. Note that it is also possible to manufacture an alloyed hot-dip galvanized steel sheet by thermal alloying of zinc plating formed on the steel sheet surface. Here, Si in steel is an easily oxidized element, and is selectively oxidized even in a generally used reducing atmosphere or non-oxidizing atmosphere, and is concentrated on the steel sheet surface and forms an oxide. This oxide reduces wettability of the steel sheet and the hot-dip galvanizing during the hot-dip galvanizing treatment, and causes a non-plating defect.

From such a background, a technique of controlling generation of the non-plating defect has been proposed. Specifically, Patent Literature 1 discloses a method of controlling surface concentration of Si by raising a dew point in a heating furnace by injection of a humidified gas into an annealing furnace and internally oxidizing Si. In addition, Patent Literature 2 discloses a method of controlling a temperature of a plating bath by setting a target temperature of a steel sheet at a specific position before plating bath immersion and controlling a temperature of the steel sheet entering the plating bath by controlling a cooling zone of an annealing furnace. In addition, Patent Literature 3 discloses a method of reducing a generation frequency of a non-plating defect by controlling vaporization of hot-dip galvanizing and generation of a plating bath surface oxide film by controlling a dew point in a snout.

CITATION LIST

Patent Literature

Patent Literature 1: Japanese Patent No. 6607339
Patent Literature 2: Japanese Patent No. 4507681
Patent Literature 3: Japanese Patent No. 5834775

SUMMARY

Technical Problem

However, even in the methods disclosed in Patent Literature 1 to 3, a non-plating defect may be generated. Specifically, a difference is often seen between a front surface side and a back surface side of a steel sheet. Having no difference between the front surface side and the back surface side on the steel sheet contributes to improvement in a yield. However, a side where many non-plating defects are generated may change depending on a manufacturing line, a date and time, and timing, and a cause thereof is not clear.

The present invention has been made in view of the above problems, and an object thereof is to provide a steel-sheet non-plating defect prediction method capable of accurately predicting generation of a non-plating defect of a steel sheet. In addition, another object of the present invention is to provide a steel-sheet defect reduction method capable of reducing a generation frequency of a non-plating defect of a steel sheet. Another object of the present invention is to provide a hot-dip galvanized steel sheet manufacturing method capable of improving a manufacturing yield of a hot-dip galvanized steel sheet. Furthermore, another object of the present invention is to provide a steel-sheet non-plating defect prediction model generation method capable of generating a non-plating defect prediction model that accurately predicts generation of a non-plating defect of a steel sheet.

Solution to Problem

To solve the problem and achieve the object, a steel-sheet non-plating defect prediction method according to the present invention is the steel-sheet non-plating defect prediction method in manufacturing equipment of a hot-dip galvanized steel sheet which equipment includes an annealing furnace, and a plating device arranged on a downstream side of the annealing furnace, the method includes: a step of predicting steel-sheet non-plating defect information on an exit side of the manufacturing equipment by using a non-plating defect prediction model which is learned by machine learning, the non-plating defect prediction model for which an input data is data including one or two or more parameters selected from attribute information of a steel sheet charged into the manufacturing equipment, one or two or more operational parameters selected from operational parameters of the annealing furnace, and one or two or more operational parameters selected from operational parameters of the plating device, and an output data is non-plating defect information of the steel sheet on the exit side of the manufacturing equipment.

Moreover, the annealing furnace is a vertical annealing furnace in which a heating zone, a soaking zone, and a cooling zone are arranged in this order from an upstream side, and dew point information of the heating zone and the soaking zone may be included as the operational parameter of the annealing furnace which parameter is included in the input data.

Moreover, the plating device is a plating device in which a snout, a plating bath, and a wiping device are arranged in this order from the upstream side, and a temperature of the plating bath and a temperature of the steel sheet entering the plating bath may be included as the operational parameters of the plating device which parameters are included in the input data.

Moreover, one or two or more operational parameters selected from operational parameters of the wiping device may be included as the operational parameters of the plating device which parameters are included in the input data.

Moreover, a steel-sheet defect reduction method according to the present invention includes: a resetting step of predicting non-plating defect information of a steel sheet by the steel-sheet non-plating defect prediction method according to the present invention by using the attribute information of the steel sheet, result values of the operational parameters of the annealing furnace, and set values of the operational parameters of the plating device before a tip portion of the steel sheet is charged into the plating device, and resetting the operational parameters of the plating device in such a manner that a non-plating defect generation rate according to the predicted non-plating defect information of the steel sheet is within a preset allowable range.

Moreover, a manufacturing method of a hot-dip galvanized steel sheet according to the present invention includes: a step of manufacturing a hot-dip galvanized steel sheet by using the steel-sheet defect reduction method according to the present invention.

Moreover, a steel-sheet non-plating defect prediction model generation method according to the present invention is the steel-sheet non-plating defect prediction model generation method in manufacturing equipment of a hot-dip galvanized steel sheet which equipment includes an annealing furnace and a plating device arranged on a downstream side of the annealing furnace, the method includes: a non-plating defect prediction model generating step of acquiring a plurality of pieces of learning data in which at least one or two or more pieces of result data selected from attribute information of a steel sheet charged into the manufacturing equipment, one or two or more pieces of operation performance data selected from operational parameters of the annealing furnace, and one or two or more pieces of operational performance data selected from operational parameters of the plating device are input performance data, and non-plating defect information of the steel sheet on an exit side of the manufacturing equipment using the input performance data is output performance data, and generating the non-plating defect prediction model by machine learning using the acquired plurality of pieces of learning data, the non-plating defect prediction model being configured to predict the non-plating defect information of the steel sheet on the exit side of the manufacturing equipment.

Moreover, machine learning selected from a neural network, decision tree learning, random forest, and support vector regression may be used as the machine learning.

Advantageous Effects of Invention

The steel-sheet non-plating defect prediction method according to the present invention can accurately predict generation of a non-plating defect of a steel sheet. In addition, according to the steel-sheet defect reduction method of the present invention, a generation frequency of the non-plating defect of the steel sheet can be reduced. Furthermore, according to the hot-dip galvanized steel sheet manufacturing method of the present invention, a manufacturing yield of the hot-dip galvanized steel sheet can be improved. Furthermore, according to the steel-sheet non-plating defect prediction model generation method of the present invention, it is possible to generate a non-plating defect prediction model that accurately predicts generation of the non-plating defect of the steel sheet.

DESCRIPTION OF EMBODIMENTS

Hereinafter, one embodiment of the present invention will be described with reference to the drawings.

[Configuration of Manufacturing Equipment of a Hot-Dip Galvanized Steel Sheet]

Figure 2:
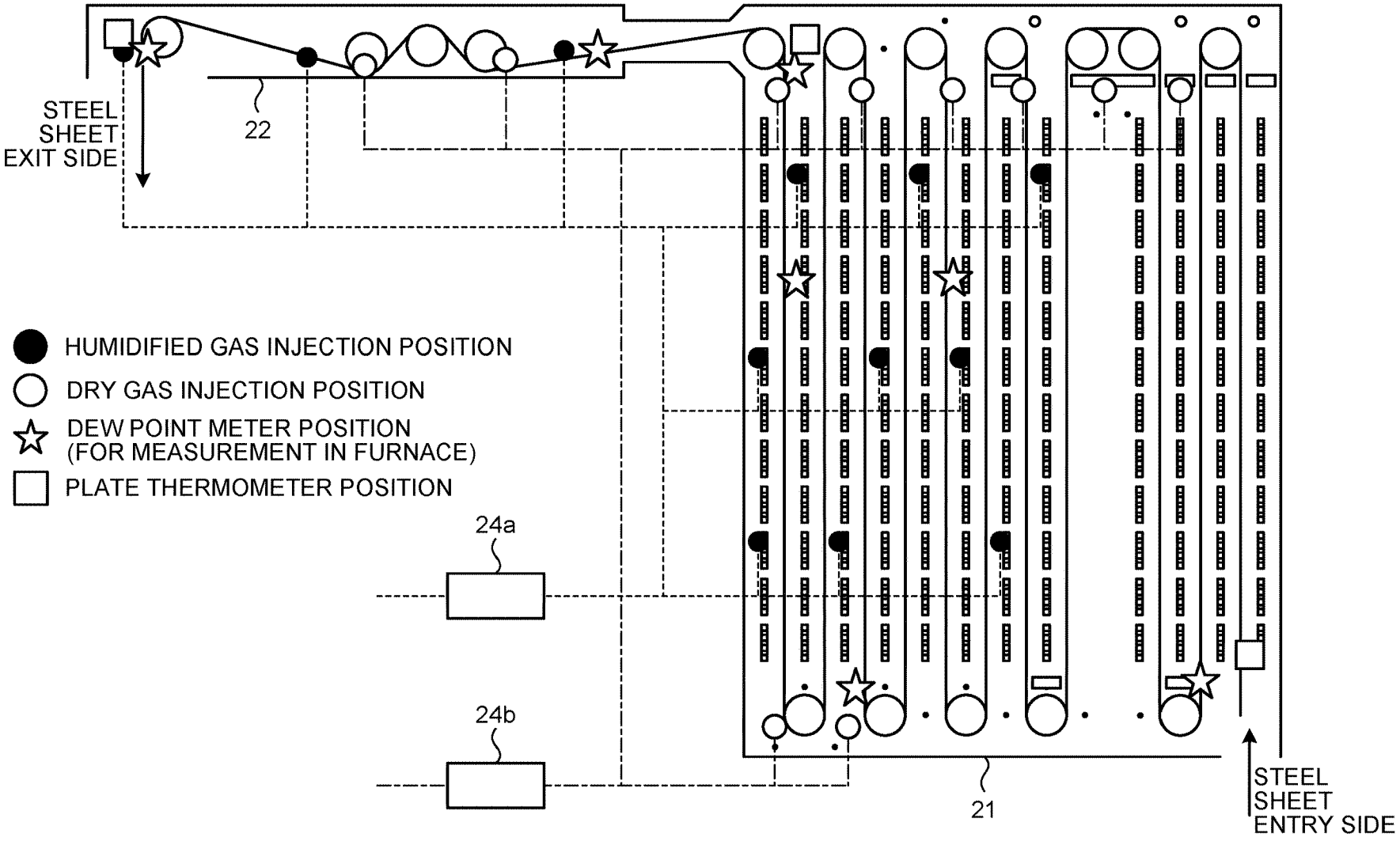
FIG. 2 is a schematic diagram illustrating a configuration of an annealing furnace illustrated in FIG. 1.
Figure 3:
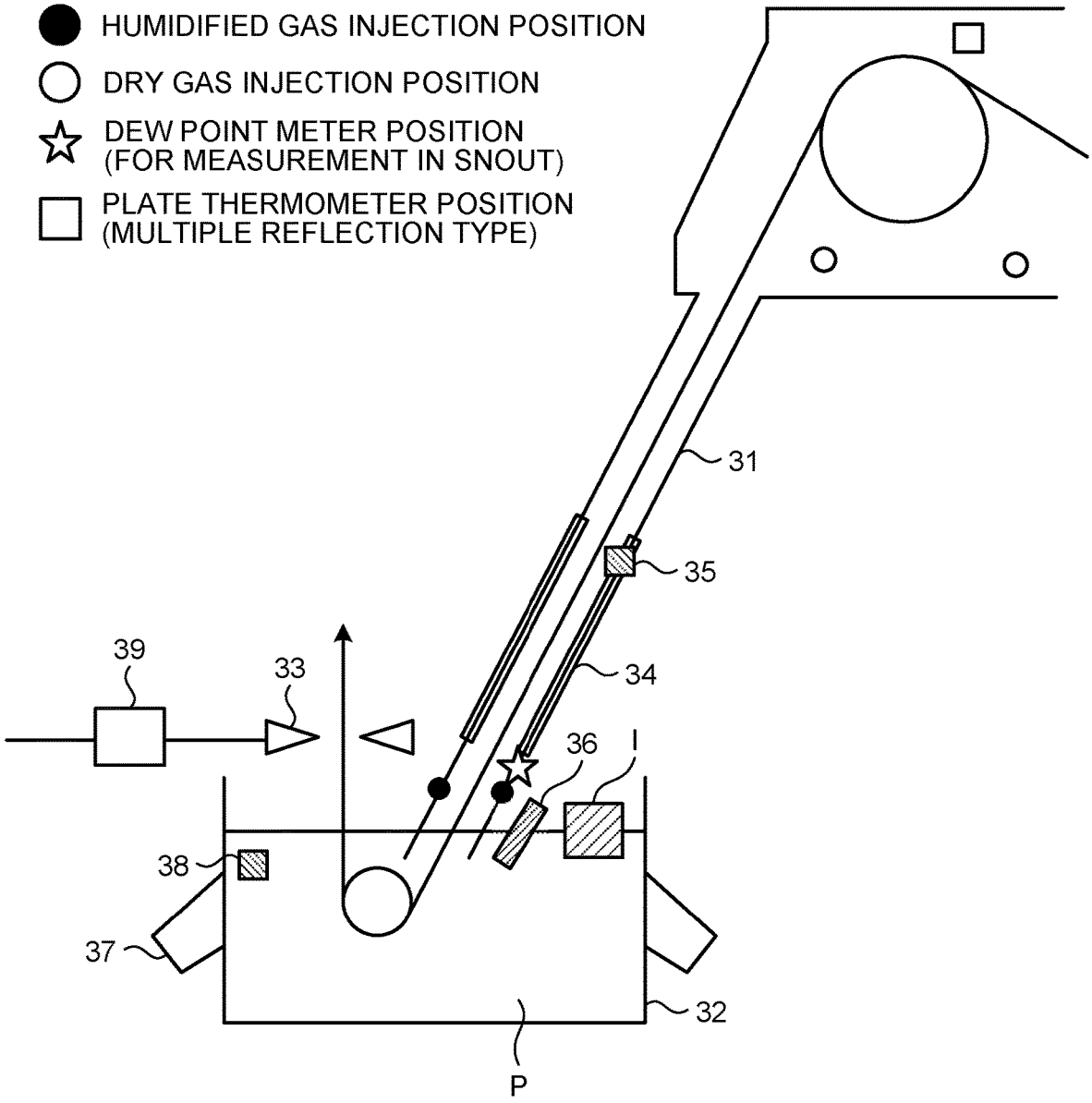
FIG. 3 is a schematic diagram illustrating a configuration of a plating device illustrated in FIG. 1.

First, a configuration of manufacturing equipment of a hot-dip galvanized steel sheet according to the one embodiment of the present invention will be described with reference to FIG. 1 to FIG. 3.

Figure 1:
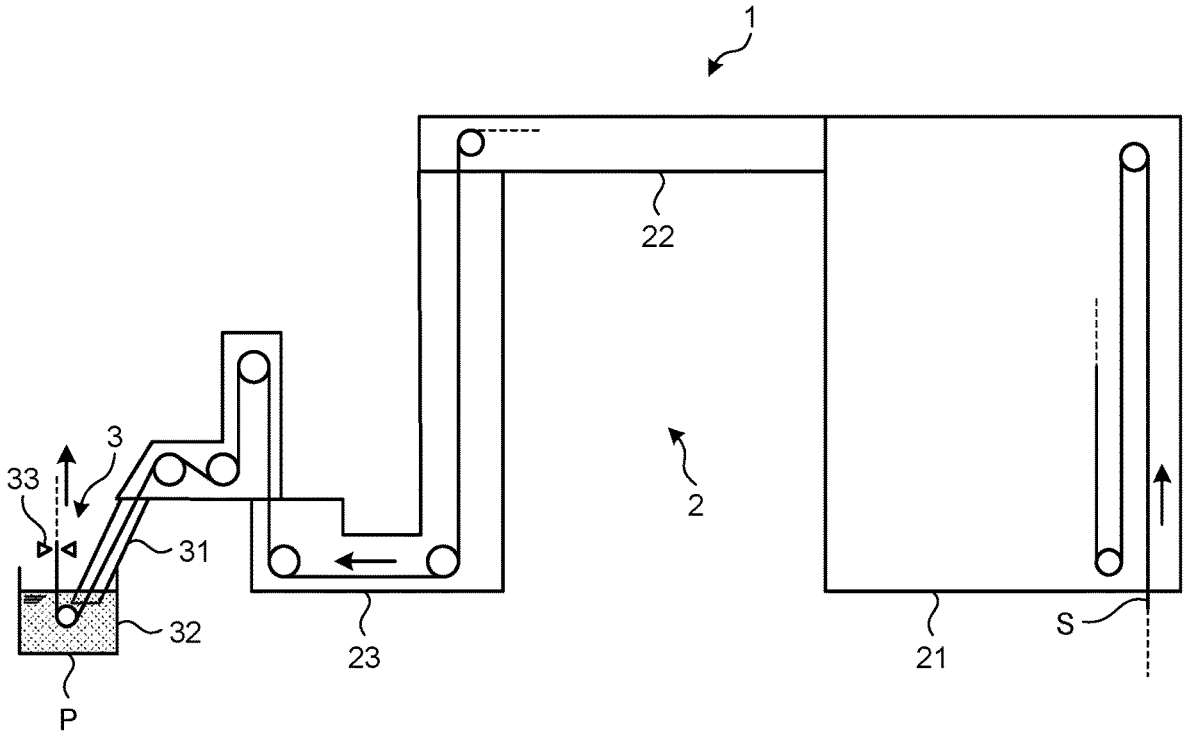
FIG. 1 is a schematic diagram illustrating a configuration of manufacturing equipment of a hot-dip galvanized steel sheet according to one embodiment of the present invention.

FIG. 1 is a schematic diagram illustrating a configuration of manufacturing equipment of a hot-dip galvanized steel sheet according to the one embodiment of the present invention. FIG. 2 is a schematic diagram illustrating a configuration of an annealing furnace 2 illustrated in FIG. 1. FIG. 3 is a schematic diagram illustrating a configuration of a plating device 3 illustrated in FIG. 1.

As illustrated in FIG. 1, a manufacturing equipment 1 for a hot-dip galvanized steel sheet according to the one embodiment of the present invention includes the vertical annealing furnace 2 and the plating device 3 arranged on a downstream side of the annealing furnace 2.

The annealing furnace 2 includes a heating zone 21, a soaking zone 22, and a cooling zone 23. The heating zone 21 and the soaking zone 22 anneal a steel sheet S by heating of the steel sheet S to a predetermined annealing temperature. The cooling zone 23 cools the annealed steel sheet S, and then conveys the steel sheet S to the plating device 3. In the annealing furnace 2, appropriate amounts of humidified gas and dry gas (injected gas) are injected into the annealing furnace 2 in such a manner that the dew point in the annealing furnace 2 becomes uniform at a target dew point. Note that as illustrated in FIG. 2, although the number of injection places of the humidified gas and that of the dry gas are respectively 12 and 10 in the present embodiment, the number of injection places of the humidified gas and that of the dry gas are not specifically limited as long as the dew point in the annealing furnace 2 becomes uniform at the target dew point.

Furthermore, measurement devices 24*a* and 24*b* to measure a flow rate, a temperature, and a dew point of the injected gas are installed on an entry side of the injection places of the injected gas. Although it is preferable that the flow rate of the injected gas can be measured at each of the injection places, the total amount of the injected gas in the entire annealing furnace 2 may be measured. Note that although dew point meters to measure the dew point in the annealing furnace 2 are installed at four places in the heating zone 21 and two places in the soaking zone 22 in the present embodiment, more dew point meters may be installed since it is easier to manage the dew point by installing a plurality of dew point meters. In addition, since the steel sheet S is heated from about 300° C. to about 700 to 900° C. in the heating zone 21 and the soaking zone 22, plate thermometers to measure the temperature of the steel sheet S are installed at least at three places that are an entry side and an exit side of the heating zone 21 and an exit side of the soaking zone 22. Similarly to the dew point meters, since management becomes easier when a plurality of plate thermometers is provided, more plate thermometers may be installed.

The description returns to FIG. 1. The plating device 3 includes a snout 31, a pot 32, and a wiping nozzle 33. The snout 31 is a member that defines a space through which the steel sheet S passes and has a rectangular cross-sectional shape perpendicular to a traveling direction of the steel sheet S, and a tip portion thereof is immersed in a hot-dip galvanizing bath (hereinafter, abbreviated as plating bath) P in the pot 32. In the present embodiment, the steel sheet S annealed in the annealing furnace 2 passes through the snout 31, and is continuously immersed in the plating bath P in the pot 32. The consumed hot-dip galvanizing is replenished by supply of an ingot I of a hot-dip galvanizing bath component (see FIG. 3) into the pot 32. Subsequently, the steel sheet S is pulled up above the plating bath P via a sink roll and a support roll in the plating bath P.

The wiping nozzle 33 is arranged above the pot 32 in a facing manner with the steel sheet S interposed therebetween. The wiping nozzle 33 blows a wiping gas from an opening (slit) extending in a width direction of the steel sheet S toward the steel sheet S pulled up from the plating bath P. Excess hot-dip galvanizing on both surfaces of the steel sheet S is squeezed out by blowing of the wiping gas, an amount of hot-dip galvanizing adhesion on the both surfaces of the steel sheet S is adjusted and is uniformized in the width direction and a longitudinal direction of the steel sheet S.

Furthermore, in the plating device 3, an appropriate amount of the humidified gas and the dry gas (injected gas) are injected into the snout 31 in such a manner that the dew point in the snout 31 becomes uniform at the target dew point. As illustrated in FIG. 3, although the number of injection places of the humidified gas and that of the dry gas are both two in the present embodiment, the number of injection places of the humidified gas and that of the dry gas are not specifically limited as long as the dew point in the snout 31 becomes uniform at the target dew point. A nozzle pipe for the humidified gas is installed in such a manner that the humidified gas can be supplied to each of a front surface side and a back surface side of the steel sheet S. In addition, since the injection of the humidified gas is intended to control formation of an oxide film and vaporization of zinc on the plating bath surface, an injection position of the humidified gas is preferably close to the plating bath surface.

In addition, a dew point meter that measures a dew point in the snout 31 is installed in the snout 31. Similarly to the installation position of the nozzle pipe for the humidified gas, the installation position of the dew point meter is preferably close to the plating bath surface. In addition, although a measurement point of the dew point is one point on the back surface side of the steel sheet S in the present embodiment, a measurement point of the dew point may also be installed on the front surface side of the steel sheet S. In addition, a snout heater 34 that heats a wall surface of the snout 31 with energization power is installed in the snout 31 in order to control generation of a zinc oxide and adhesion of the zinc oxide to the steel sheet S due to solidification of a molten zinc vapor. In addition, a wall surface temperature of the snout 31 is measured by a thermometer 35. Note that although being installed on an upstream side of the snout heater 34 in the present embodiment, the thermometer 35 may be installed on a downstream side of the snout heater 34.

In addition, the pot 32 includes an online bath analyzer 36 to constantly monitor composition such as an Al concentration of the plating bath P, an inductor 37 that heats the plating bath P by energization power, and a thermometer 38 that measures the temperature of the plating bath P. Furthermore, a measurement device 39 that measures a flow rate, a temperature, and a pressure of the wiping gas is connected to the wiping nozzle 33. The flow rate, the temperature, and the pressure of the wiping gas are measured before a blowing port of the wiping gas. In addition, the ingot I, whose component is prepared in advance, is used for replenishing the consumed hot-dip galvanizing. In addition, the concentration of the bath component of the plating bath P may be managed by utilization of a concentration measuring device that can perform measurement online, or may be managed by periodically collection of a sample from the plating bath P and analyzing of the sample by an inductivity coupled plasma (ICP) analysis method or the like.

[Configuration of a Steel-Sheet Non-Plating Defect Prediction Model Generation Device]

Next, a configuration of the steel-sheet non-plating defect prediction model generation device of the one embodiment of the present invention will be described with reference to FIG. 4 to FIG. 8.

Figure 4:
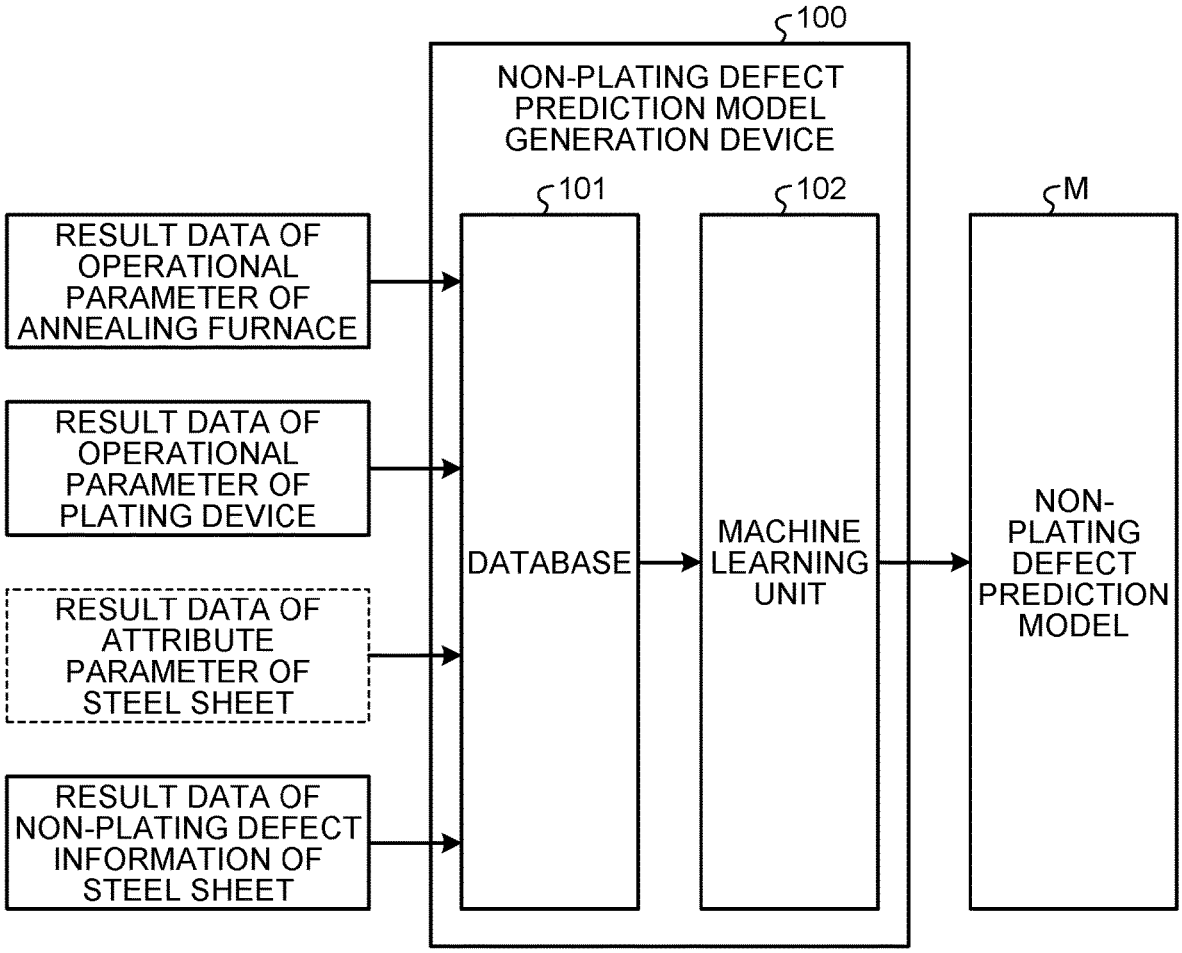
FIG. 4 is a block diagram illustrating a configuration of a steel-sheet non-plating defect prediction model generation device according to the one embodiment of the present invention.

FIG. 4 is a block diagram illustrating the configuration of the steel-sheet non-plating defect prediction model generation device of the one embodiment of the present invention. As illustrated in FIG. 4, the steel-sheet non-plating defect prediction model generation device 100 of the one embodiment of the present invention includes an information processing device such as a workstation, and includes a database 101 and a machine learning unit 102.

The database 101 includes a nonvolatile storage device, and stores result data of operational parameters of the annealing furnace 2, result data of operational parameters of the plating device 3, result data of attribute parameters of the steel sheet S, and result data of non-plating defect information of the steel sheet S.

Examples of the operational parameters of the annealing furnace 2 include a sheet passing speed of the steel sheet S, injected gas information (such as a temperature, flow rate, component, dew point, and the like of the injected gas), dew point information in the annealing furnace 2, and temperature information of the steel sheet S. This is because the sheet passing speed of the steel sheet S affects time during which the steel sheet S stays in the annealing furnace, and affects surface concentration amounts of Si and Mn. Specifically, in a case where the sheet passing speed is low (approximately 60 mpm or lower), annealing time becomes long. Thus, a surface concentration layer of Si and Mn is likely to be formed even when the dew point in the annealing furnace is constant, whereby the plating property is affected adversely. This is because the injected gas information, the dew point information in the annealing furnace 2, and the temperature information of the steel sheet S affect the surface concentration and material quality of Si and Mn. In a steel type containing Si and Mn, the surface concentration of Si and Mn is the most promoted when the dew point in the annealing furnace 2 is in a range of −40 to −30° C., and the surface concentration of Si and Mn is controlled and internal oxidation of Si and Mn tends to be promoted as the dew point is increased in a range of −30 to 0° C. In addition, when the dew point is set to −45° C. or lower, the surface concentration of Si and Mn tends to be controlled. In addition, when the annealing temperature is 750° C. or higher, the surface concentration of Si and Mn tends to be promoted.

Si and Mn in steel are easily oxidized elements, are selectively oxidized even in the generally used reducing atmosphere or non-oxidizing atmosphere, and form oxides by being concentrated on the surface of the steel sheet S. The oxides of Si and Mn formed on the surface of the steel sheet S tends to reduce wettability of molten zinc when the steel sheet S is immersed in the plating bath. That is, the plating property is deteriorated. The non-plating of the steel sheet in the present embodiment means that a region in which zinc does not locally adhere to the surface of the steel sheet S is generated due to a decrease in the wettability of molten zinc to the steel sheet S. Thus, the non-plating defect of the steel sheet is recognized as a recessed defect in which the base material is locally exposed on the surface of the steel sheet S.

As the temperature information of the steel sheet S which information can be used as the operational parameter of the annealing furnace 2, sheet temperature data measured by at least one plate thermometer selected from the plate thermometers set in the annealing furnace 2 may be used. Furthermore, as the dew point information in the annealing furnace 2, dew point data measured by at least one dew point meter selected from the dew point meters set in the annealing furnace 2 may be used. Furthermore, as the injected gas information (such as the temperature, flow rate, component, dew point, and the like of the injected gas), measurement data of the measurement devices 24*a* and 24*b* to measure the flow rate, the temperature, and the dew point of the injected gas injected into the furnace of the annealing furnace 2 may be used. This is because these pieces of information affect an amount of the oxides of Si and Mn that can be formed on the surface of the steel sheet S.

The operational parameters of the annealing furnace 2 are not limited to the above, and may include information related to an output of a combustion device, such as a combustion rate and an amount of the injected fuel (amount of fuel gas) of a radiant tube burner installed in the annealing furnace 2. This is because a temperature history of the steel sheet S in the annealing furnace 2 is affected, and concentration behavior of Si and Mn on the surface of the steel sheet S is affected. Furthermore, a hydrogen concentration and a carbon monoxide concentration in the annealing furnace 2 may be measured, and these may be included in the operational parameters of the annealing furnace 2 as atmosphere information in the annealing furnace 2. This is because an oxygen potential in the furnace changes depending on a hydrogen concentration in the annealing furnace even in an atmosphere having the same dew point, and thus the surface concentration behavior of Si and Mn is affected. For example, when the hydrogen concentration in the annealing furnace is high, the oxygen potential in the furnace decreases even in the atmosphere having the same dew point, whereby the surface concentration of Si and Mn tends to be controlled. In addition, when a carbon monoxide concentration in the annealing furnace 2 is high, decarburization may be generated on the surface of the steel sheet S due to an influence of a trace amount of moisture in the annealing furnace 2, and this affects the wettability of molten zinc.

Figure 5:
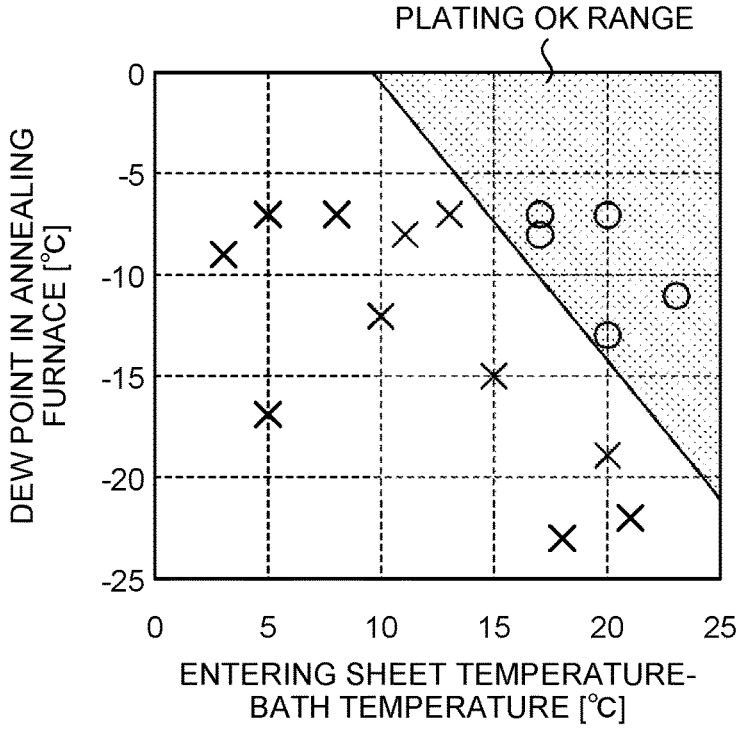
FIG. 5 is a view illustrating an influence of a difference between a temperature of a steel sheet entering a hot-dip galvanizing bath and a temperature of the hot-dip galvanizing bath (entering sheet temperature-bath temperature) and a dew point in the annealing furnace on plating property.

Here, results of investigation of influence of a difference between the temperature of the steel sheet S entering the plating bath P and the temperature of the plating bath P (entering sheet temperature-bath temperature) and the dew point in the annealing furnace on the plating property are illustrated in FIG. 5. As illustrated in FIG. 5, it can be seen that good/bad regions of the plating property can be arranged according to the difference between the temperature of the steel sheet S entering the plating bath P and the temperature of the plating bath P and the dew point in the annealing furnace. Since the dew point in the annealing furnace is related to the surface concentration amounts of Si and Mn, and the difference between the temperature of the steel sheet S entering the plating bath P and the temperature of the plating bath P is related to the plating property, it is suggested that a combination of the both is important. From the above, it can be estimated that data analysis using both the parameter related to the surface concentration amount of Si or Mn and the parameter related to the plating property is important in order to accurately predict the non-plating defect.

The operational parameters of the plating device 3 include information related to a snout condition, information related to a pot condition, and information related to a wiping condition. Examples of the information related to the snout condition include information of the snout heater 34 (such as power supplied to the snout heater 34), temperature information of the steel sheet S in the snout 31, injected gas information in the snout 31 (temperature, flow amount, and component), dew point information in the snout 31, and temperature information of a wall surface of the snout 31. Examples of the information related to the pot condition include information related to the inductor 37 (such as power supplied to the inductor 37), information related to the ingot I (such as the component of the ingot I), temperature information of the steel sheet S entering the plating bath P, and temperature information of the plating bath P. Examples of the information related to the wiping condition include information related to the wiping gas (temperature and flow rate), a wiping gas pressure setting value, a nozzle height, a nozzle injection angle, a distance between the nozzle and the steel sheet, a plating weight setting value, and the like.

The information of the snout heater 34, the temperature information of the steel sheet S in the snout 31, and the temperature information of the wall surface of the snout 31 affect the temperature of the steel sheet S entering the plating bath P and the temperature of the plating bath P. Specifically, when the temperature of the steel sheet S entering the plating bath P decreases, reactivity between the steel sheet S and the plating bath P decreases and the plating adhesion decreases, whereby the non-plating defect is likely to be generated. On the other hand, when the temperature of the steel sheet S entering the plating bath P is too high, the temperature of the plating bath P increases and the temperature of the plating bath P cannot be stably maintained. Alternatively, an amount of iron eluted from the steel sheet S increases, and an Fe—Zn—Al intermetallic compound called dross increases and adheres to the steel sheet S, whereby dross surface defects increase. In addition, when the temperature of the plating bath P increases, the difference between the temperature of the steel sheet S and the temperature of the plating bath P (entering sheet temperature-bath temperature) decreases, and the plating property decreases.

Figure 6:
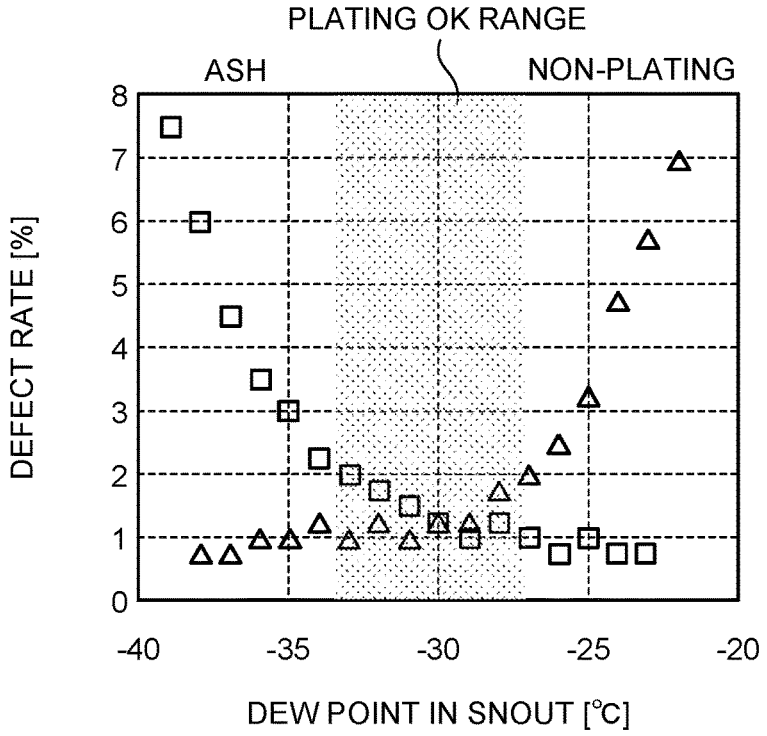
FIG. 6 is a view illustrating an influence of a dew point in a snout on the plating property.
Figure 7:
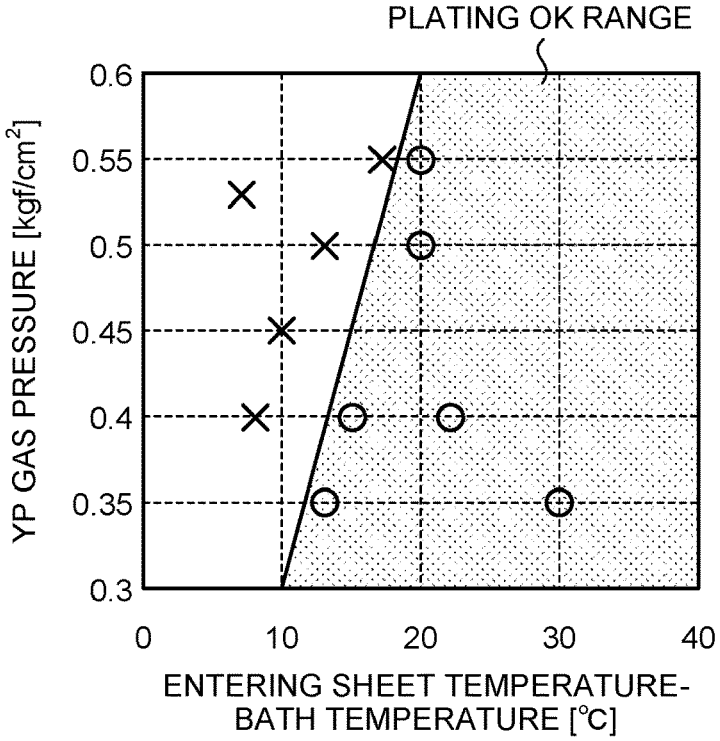
FIG. 7 is a view illustrating an influence of the difference between the temperature of the steel sheet entering the hot-dip galvanizing bath and the temperature of the hot-dip galvanizing bath (entering sheet temperature-bath temperature) and wiping gas pressure on the plating property.

The injected gas information in the snout 31 and the dew point information in the snout 31 affect the oxide film on the plating bath surface. When the steel sheet S is immersed in the plating bath P, the oxide film generated on the plating bath surface placed in the snout 31 adheres to the surface of the steel sheet S in association and deteriorates the plating property. Specifically, as illustrated in FIG. 6, in a range in which the dew point in the snout is −33° C. or lower, generation of zinc fumes becomes remarkable, and the zinc fumes adhere to, solidify, and accumulate on the inner wall of the snout 31, randomly falls, adheres to the steel sheet S, and becomes an ash defect. On the other hand, when the dew point in the snout is in a range of −27° C. or higher, the oxide film is formed on the plating bath surface in the snout 31, and plating adhesion is inhibited in association with the steel sheet S. Thus, the dew point in the snout may be controlled within a range of −33 to −27° C. However, the preferred dew point range varies depending on the temperature of the steel sheet S entering the plating bath P, the conveying speed of the steel sheet S, and the steel type of the steel sheet S.

The information related to the inductor 37, the temperature information of the steel sheet S entering the plating bath P, and temperature information on the plating bath P may be used as the information that is related to the pot condition and that is the operational parameter of the plating device 3. The temperature information of the steel sheet S entering the plating bath P and the temperature information of the plating bath P affect temperature management of the plating bath P and the plating property, and the information related to the ingot I affects the temperature of the plating bath P and the concentration of the bath component. A target value of the temperature of the plating bath P is set in a range of 450 to 460° C., and the output of the inductor 37 is adjusted in such a manner as to be constant. However, the temperature of the plating bath P constantly changes due to factors such as a decrease in the temperature of the plating bath P due to the supply of the ingot I, a change in the temperature of the plating bath P due to a change in the temperature of the steel sheet S entering the plating bath P, and a decrease in the temperature of the plating bath P due to the wiping gas. Thus, the temperature of the plating bath P may be controlled specifically in consideration of the temperature of the steel sheet S entering the plating bath P. By controlling the factors that affect the temperature change of the plating bath P as the operational parameters, it is possible to adjust the plating property of molten zinc on the steel sheet S. In addition, since affecting adhesion between the steel sheet S and zinc, an alloying reaction of a galvanized film, and oxide formation on the plating bath surface, the Al concentration of the plating bath P is controlled to an appropriate value in a range of 0.125 to 0.14% in a case of an alloyed hot-dip galvanized steel sheet (GA) and of 0.19 to 0.23% in a case of a hot-dip galvanized steel sheet (GI). Thus, the Al concentration of the plating bath P may be included in the pot condition that is the operational parameter of the plating device 3.

The information related to the wiping gas, the wiping gas pressure setting value, the nozzle height, the nozzle injection angle, the distance between the nozzle and the steel sheet, and the plating weight setting value affect the temperature of the plating bath surface and the wall surface temperature of the snout 31. Specifically, the wiping gas pressure is adjusted to control the galvanizing adhesion amount, becomes higher as the sheet passing speed becomes higher, and becomes higher as a target plating adhesion amount becomes smaller. The wiping gas is injected from the wiping nozzle at a temperature of 30 to 150° C. and an air velocity of as high as 100 to 300 m/s, collides with the steel sheet S, flows along the steel sheet S, and goes around the plating bath surface. Thus, the plating bath surface and the wall surface of the snout 31 are cooled by the wiping gas, and the temperature of the hot-dip galvanizing bath in the vicinity of the bath surface also decreases. Since the reactivity between the plating bath P and the steel sheet S changes due to the temperature decrease in the hot-dip galvanizing bath, the wiping gas pressure (YP gas pressure) may be considered as the operational parameter of the plating device 3 (see FIG. 7).

Examples of the attribute parameter of the steel sheet S include information related to a component composition of the steel sheet S and dimensional information (thickness and width) of the steel sheet S. The information related to the component composition of the steel sheet S can be specified according to the content of the component element included in the steel sheet S. For example, the C content, the Si content, the Mn content, and the like of the steel sheet S are used. The information related to the component composition of the steel sheet S may include the contents of Cr, Mo, Nb, Ni, Al, Ti, Cu, Ni, and B in addition to the contents of C, Si, and Mn. The information related to the component composition of the steel sheet S preferably includes the Si content and the Mn content of the steel sheet S. This is because a concentration behavior on the surface of the steel sheet S changes in the annealing furnace 2 according to the Si content and the Mn content of the steel sheet S, and affects the plating property. However, since the concentration behavior of Si and Mn on the surface of the steel sheet S is affected not only by the Si content and the Mn content but also by a combination with other elements, information related to the component composition may be added in addition to the Si content and the Mn content. In addition, it is preferable to use the C content as the information related to the component composition of the steel sheet S. This is because when moisture in the annealing furnace 2 and C in the steel sheet S are bonded in the annealing furnace 2 and a phenomenon of desorption of C from the surface of the steel sheet S is generated, water consumption in the annealing furnace 2 changes according to the C content and the dew point in the furnace is affected. On the other hand, this is because the thickness and width of the steel sheet S affect various temperature parameters.

The non-plating defect information of the steel sheet S in the present embodiment means information related to a generation state of the non-plating defect of the steel sheet S which state is observed on an exit side of the manufacturing equipment 1 of the hot-dip galvanized steel sheet. When the non-plating is generated on the surface of the steel sheet S, zinc does not adhere to the portion, whereby a rust prevention effect required as the hot-dip galvanized steel sheet is not exhibited. Thus, the non-plating generated on the surface of the steel sheet S is determined as the non-plating defect of the steel sheet S. As the non-plating defect information of the steel sheet S, any index representing the generation state of the non-plating defect of the steel sheet S, such as presence or absence of the non-plating defect of the steel sheet S, the number and an area ratio of the non-plating defects can be used. In addition, the steel sheet S may be divided in the longitudinal direction, and the presence or absence, the number, the area ratio, and the like of the non-plating defects within the divided ranges may be determined.

Figure 8:
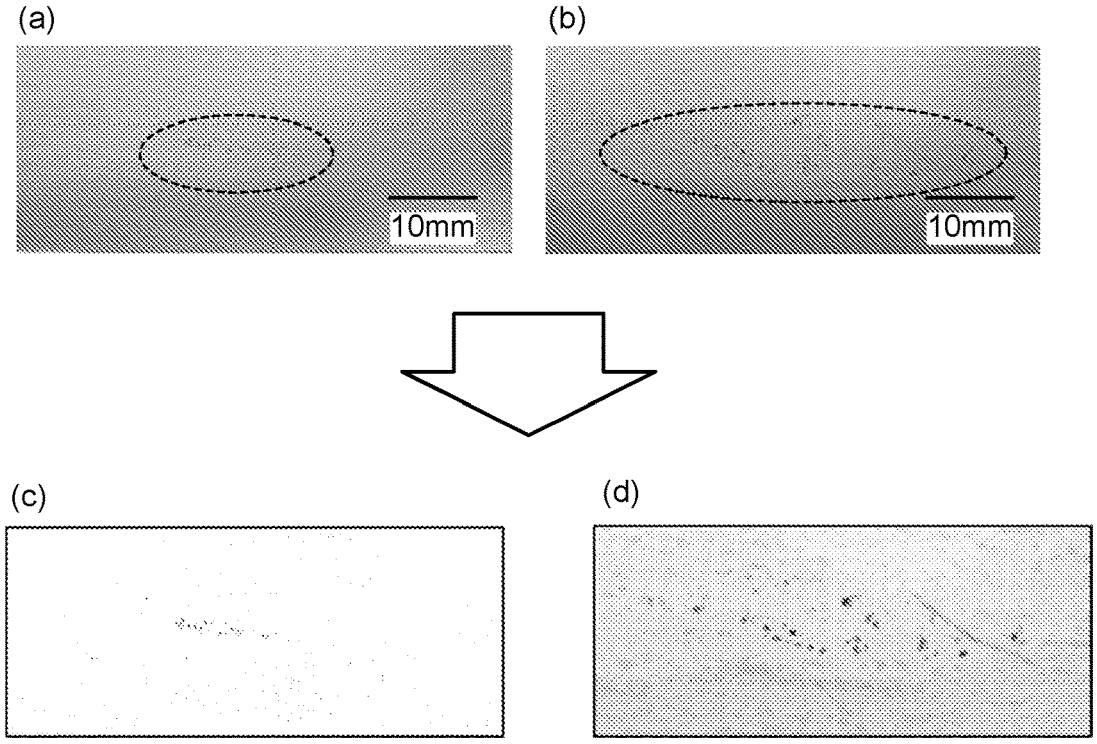
FIG. 8 is a view illustrating an example of an image of a non-plating defect.

The non-plating defect information of the steel sheet S can be acquired from an image or a moving image of the steel sheet S captured by a camera or the like installed on the exit side of the manufacturing equipment 1 of the hot-dip galvanized steel sheet. Specifically, the information may be acquired by plating appearance evaluation by image processing using a surface inspection device, a micro defect meter, or the like or acquired by plating appearance evaluation by visual observation by an operator. Examples of an evaluation method include a method of identifying the non-plating defect by using a difference in polarization reflection characteristics of a surface pattern. Actual non-plating appearance photographs are illustrated in FIGS. 8(*a*) and 8(*b*). With respect to the images of the steel sheet S in a manner illustrated in FIGS. 8(*a*) and 8(*b*), image processing is performed and it is determined whether the plating property is good or bad, and what is converted into data is used as information related to the plating appearance evaluation. Images in which bright portions and dark portions are emphasized by application of the image processing to the images of the steel sheet S illustrated in FIGS. 8(*a*) and 8(*b*) are illustrated in FIGS. 8(*c*) and 8(*d*). By performing the image processing on the images of the steel sheet S in such a manner, the non-plating defect portion can be recognized as a point-like or streak-like defect. As a determination criterion, for example, when an image of 1000 mm in the width direction×3000 mm in the longitudinal direction is photographed during passage of the steel sheet S having a width of 1000 mm, in a case where there is the non-plating defect portion as illustrated in FIGS. 8(*c*) and 8(*d*), it is determined that "there is a non-plating defect". The image to be photographed may be a moving image or a still image. In a case of the still image, it is preferable that the number of times of photographing is large, and it is preferable to photograph images of at least three points that are a tip portion, a stationary portion, and a tail end portion of a coil.

In a case where the non-plating defect is detected by the image processing using the surface inspection device, lightness of the defect portion, a size of the defect portion, and a defect form (such as a point group shape, streak shape, or amorphous shape) are determined, and the number and area ratio per unit area of the steel sheet S may be calculated. Note that surface defects of the steel sheet S detected on the exit side of the manufacturing equipment 1 of the hot-dip galvanized steel sheet include a dross defect in addition to the non-plating defect. In this case, while the non-plating defect is observed as a recessed defect on the surface of the steel sheet S, the dross defect is observed as a protruding defect in which a granular intermetallic compound adheres to the surface of the steel sheet S. Thus, in the surface inspection device, the two can be identified by the lightness and shadow of a reflected image of light applied to the surface of the steel sheet S.

The machine learning unit 102 generates a non-plating defect prediction model M of predicting generation of the non-plating defect of the steel sheet S on the exit side of the manufacturing equipment 1 of the hot-dip galvanized steel sheet by machine learning using a plurality of pieces of learning data (training data) in which the result data of the operational parameters of the annealing furnace 2, the result data of the operational parameters of the plating device 3, and the result data of the attribute parameters of the steel sheet S stored in the database 101 are used as input result data, and the result data of the non-plating defect information of the steel sheet S corresponding to the input result data is used as output result data. The non-plating defect prediction model M is a computer program in which the operational parameters of the annealing furnace 2, the operational parameters of the plating device 3, and the attribute parameters of the steel sheet S are used as input data, and the non-plating defect information of the steel sheet S on the exit side of the manufacturing equipment 1 of the hot-dip galvanized steel sheet is used as output data.

A machine learning model to generate the non-plating defect prediction model M may be any machine learning model as long as practically sufficient prediction accuracy can be acquired. For example, commonly used neural networks (including deep learning, convolutional neural network, and the like), decision tree learning, a random forest, support vector regression, and the like may be used. In addition, an ensemble model in which a plurality of models is combined may be used. Furthermore, a classification model such as a k-nearest neighbor algorithm or logistic regression can also be used.

[Configuration of a Steel-Sheet Non-Plating Defect Prediction Device]

Next, a configuration of the steel-sheet non-plating defect prediction device of the one embodiment of the present invention will be described with reference to FIG. 9.

Figure 9:
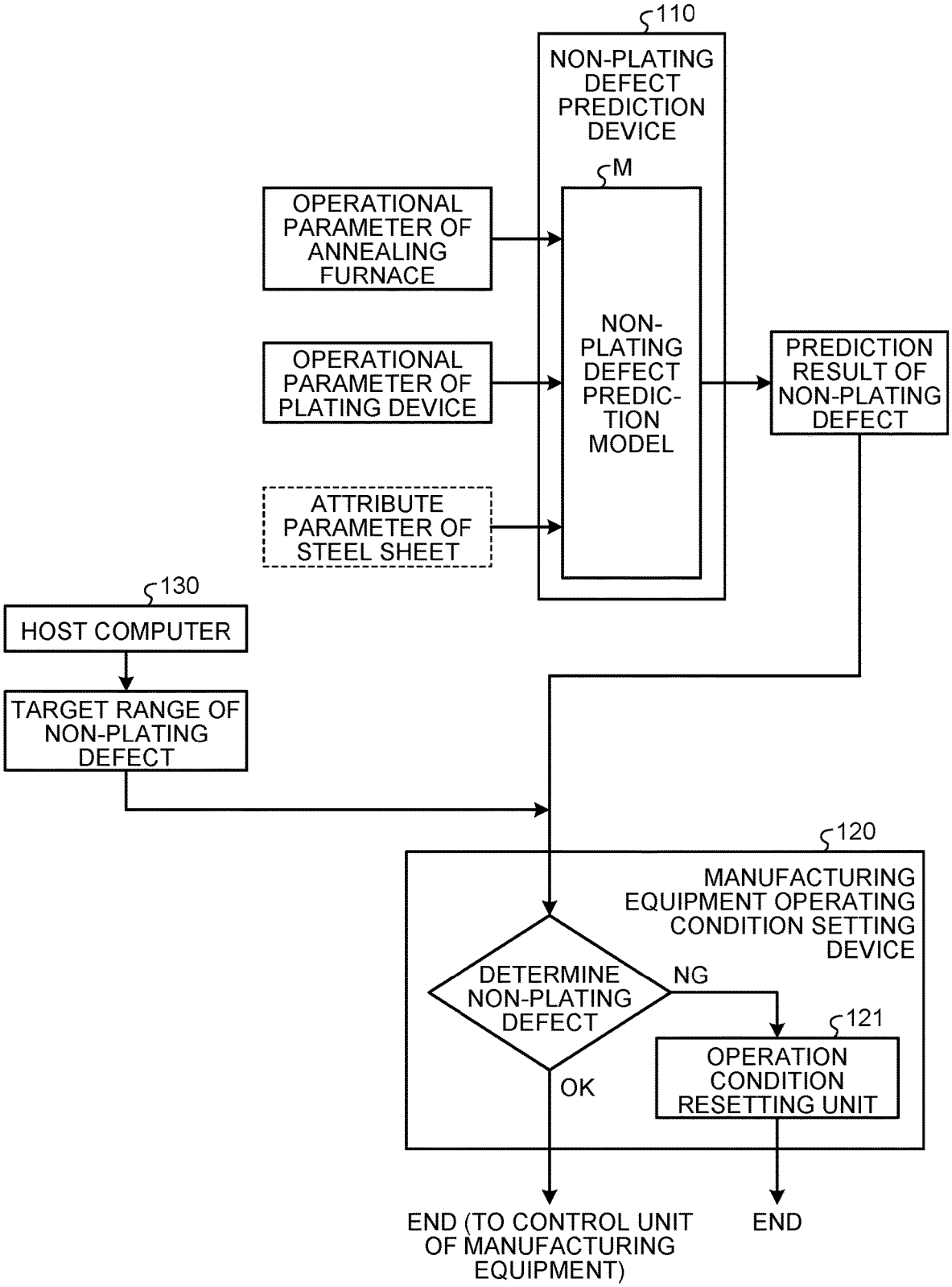
FIG. 9 is a block diagram illustrating a configuration of a steel-sheet non-plating defect prediction device according to the one embodiment of the present invention.

FIG. 9 is a block diagram illustrating a configuration of the steel-sheet non-plating defect prediction device according to the one embodiment of the present invention. As illustrated in FIG. 9, a steel-sheet non-plating defect prediction device 110 of the one embodiment of the present invention includes an information processing device such as a personal computer. The steel-sheet non-plating defect prediction device 110 inputs a result value of an operational parameter of the annealing furnace 2, a set value of an operational parameter of the plating device 3, and an attribute parameter of the steel sheet S to the non-plating defect prediction model M before the tip portion of the steel sheet S is charged into the plating device 3, and predicts whether the non-plating defect of the steel sheet S is generated on the exit side of the manufacturing equipment 1 of the hot-dip galvanized steel sheet. Then, the steel-sheet non-plating defect prediction device 110 outputs information related to a prediction result to a manufacturing equipment operating condition setting device 120.

The manufacturing equipment operating condition setting device 120 compares a target range of a non-plating defect generation rate acquired from a host computer 130 with a plurality of the prediction results output from the steel-sheet non-plating defect prediction device 110, and determines whether the non-plating defect of the steel sheet S is good or bad. Since there are a case where the non-plating defect is generated and a case where the non-plating defect is not generated even when the operational parameters are under the same condition, it is preferable to use a probability of generation of the non-plating defect as an index. Thus, in the present embodiment, the manufacturing equipment operating condition setting device 120 determines whether the non-plating defect of the steel sheet S is good or bad on the basis of the non-plating defect generation rate. The non-plating defect generation rate can be calculated by the following formula (1) by utilization of, for example, an image photographed for the steel sheet S having operational parameters under the same condition. In addition, a similar definition can be used for the probability of prediction of non-plating defect generation. In this case, "the number of times of generation or a generation time of the non-plating defect" may be read as "the number of times or a time that the non-plating defect is predicted to be generated".

The non-plating defect generation rate=(the number of times of generation or a generation time of the non-plating defect)/(the number of times of photographing or a photographing time of a steel sheet having operational parameters of the same condition) (1)

Then, in a case where it is determined that there is no problem of the non-plating defect (the prediction result of the non-plating defect is good), the manufacturing equipment operating condition setting device 120 continues the operation of the manufacturing equipment 1 of the hot-dip galvanized steel sheet. On the other hand, in a case where it is determined that there is a problem of the non-plating defect (the prediction result of the non-plating defect is bad), an operation condition resetting unit 121 of the manufacturing equipment operating condition setting device 120 resets the operation condition of the manufacturing equipment 1 of the hot-dip galvanized steel sheet before the tip portion of the steel sheet S is charged into the plating device 3. As a result, it is possible to manufacture the hot-dip galvanized steel sheet in which a generation frequency of the non-plating defect is reduced and the manufacturing yield of the hot-dip galvanized steel sheet is improved.

In the conventional method, influence factors on a side of the steel sheet (such as an annealing dew point and an annealing temperature) and on a side of the plating bath (such as a snout dew point, a bath temperature, an Al concentration, and a relative flow rate with respect to a peripheral plating bath) are not dealt with at the same time, whereby generation of a non-plating defect cannot be predicted accurately. In addition, although a state of the plating bath itself and a temperature of the steel sheet entering the plating bath are considered as the influence factors on the side of the plating bath, the wiping condition is not considered. The wiping condition is originally an item to control a plating adhesion amount. Since a temperature of the wiping gas is about a room temperature to 100° C. in most cases, the plating bath is cooled when excess zinc plating is scraped off, and the snout wall surface and the like are also cooled. In the present embodiment, as conditions for optimizing the plating bath condition in the pot, the wiping condition and the snout wall surface temperature are also included as the parameters. Thus, in the present embodiment, since both the plating bath-side data including the wiping condition and the snout condition and the steel sheet-side data are handled at the same time, generation of the non-plating defect can be predicted more accurately than the conventional method.

As described above, the non-plating defect prediction model M of the present embodiment uses, as the input data, the attribute information of the steel sheet S charged into the manufacturing equipment 1 of the hot-dip galvanized steel sheet. As a result, it is possible to generate the non-plating defect prediction model M reflecting the influence on the oxides of Si and Mn on the surface of the steel sheet S generated in the annealing furnace 2, the influence on the dew point in the annealing furnace 2, the influence on the temperature of the steel sheet S of when the steel sheet S is immersed in the plating bath, and the like. In addition, the non-plating defect prediction model M of the present embodiment uses the operational parameters of the annealing furnace 2 as the input data. As a result, it is possible to generate the non-plating defect prediction model M reflecting the generation state of the oxides of Si and Mn on the surface of the steel sheet S of when the steel sheet S is immersed in the plating bath, the influence on the temperature of the steel sheet S and the wettability of molten zinc of when the steel sheet S is immersed in the plating bath, and the like. Furthermore, the non-plating defect prediction model M of the present embodiment uses the operational parameters of the plating device 3 as the input data. As a result, it is possible to generate the non-plating defect prediction model M reflecting the temperature of the steel sheet S of when the steel sheet S is immersed in the plating bath, the state of the oxide generated on the surface of the steel sheet S or the plating bath surface, the influence on the temperature of the plating bath and the reactivity of the steel sheet S and the molten zinc, and the like. Specifically, even when the generation state of the oxides of Si and Mn generated on the surface of the steel sheet S are similar, the generation state of the non-plating of the steel sheet S changes depending on conditions such as the temperature at which the steel sheet S is immersed in the plating bath (entering sheet temperature) and the temperature of the plating bath (bath temperature). Thus, by using these parameters in combination as the input data, it becomes possible to accurately predict the non-plating defect of the steel sheet S.

EXAMPLES

Hereinafter, a result of when the steel-sheet non-plating defect prediction method according to the present embodiment is applied to a case where a hot-dip galvanized steel sheet is acquired by forming of a galvanized layer on a surface of a thin steel sheet in continuous hot-dip galvanizing equipment, and an alloyed hot-dip galvanized steel sheet is acquired by further performance of alloying treatment on the hot-dip galvanized steel sheet will be described.

In the present example, in the manufacturing equipment 1 of the hot-dip galvanized steel sheet illustrated in FIG. 1, a manufacturing equipment 1 of a hot-dip galvanized steel sheet which equipment includes reheating equipment to perform the alloying treatment on a downstream side of a wiping nozzle 33 arranged on an exit side of a pot 32 was used. The reheating equipment had an alloying zone, a heat retaining zone, and a final cooling zone, and an induction heating device was arranged in the alloying zone. The alloying zone is equipment to form a galvanized film having an alloy layer by a Zn—Fe alloying reaction on the surface of the thin steel sheet and to manufacture an alloyed hot-dip galvanized steel sheet. The hot-dip galvanizing bath P is a Zn bath containing Al. In addition, a surface inspection device was arranged on a downstream side of the reheating equipment and on an upstream side of a product winding device of the manufacturing equipment 1 of the hot-dip galvanized steel sheet. The surface inspection device has a function of detecting a non-plating defect of a steel sheet S on which the alloying treatment is performed. The surface inspection device determined whether the non-plating defect was generated on a surface of the steel sheet S for each length set in advance in a longitudinal direction of the steel sheet S.

The alloyed hot-dip galvanized steel sheet manufactured by utilization of the manufacturing equipment 1 of the hot-dip galvanized steel sheet was manufactured by utilization of a cold-rolled steel strip coil having a sheet thickness of 1.0 to 2.3 mm and a width of 690 to 1550 mm. As steel strip coils of raw materials, steel strip coils having different sheet thicknesses and sheet widths were prepared for 10 steel types, and the alloyed hot-dip galvanized steel sheet was manufactured by utilization of the 100 steel strip coils in total. In manufacturing of these steel sheets, the operational parameters of the annealing furnace 2 and the operational parameters of the plating device 3 were changed in the longitudinal direction of the steel sheet S as a manufacturing condition of the manufacturing equipment 1 of the hot-dip galvanized steel sheet. Then, result data of non-plating defect information of the steel sheet S corresponding to the set operational parameters of the annealing furnace 2 and operational parameters of the plating device 3 was acquired by the surface inspection device.

Note that in the surface inspection device, the longitudinal direction of the steel sheet S was divided every 100 m, and presence or absence of generation of the non-plating defect in the divided range was output. Then, result data of the operational parameters of the annealing furnace 2 and the operational parameters of the plating device 3 was acquired from a control computer of the manufacturing equipment 1 of the hot-dip galvanized steel sheet for each range divided in the longitudinal direction of the steel sheet S, and was accumulated in the database 101 of the steel-sheet non-plating defect prediction model device 100. At that time, the result data of the attribute parameters of the steel sheet was also acquired from the control computer and accumulated in the database 101 in association with the result data of the operational parameters of the annealing furnace 2 and the operational parameters of the plating device 3.

As described above, when 20000 data sets were accumulated in the database 101, 1600 pieces of learning data were extracted from the database 101, and the remaining 400 pieces were set as test data. The extracted learning data was used by the machine learning unit 102 to generate the non-plating defect prediction model M. At that time, the machine learning unit 102 variously changed and selected input variables to be used for the non-plating defect prediction model M, and generated a plurality of the non-plating defect prediction models M. Then, by utilization of the test data, the prediction accuracy (accuracy rate) of the non-plating defect of the steel sheet S by the plurality of generated non-plating defect prediction models M was evaluated. As a method of machine learning, a neural network was used, the number of intermediate layers was set to three layers, and the number of nodes was set to five for each of the intermediate layers. As an activation function, a sigmoid function was used.

The accuracy rate of the non-plating defect prediction models M was evaluated for each section in the longitudinal direction of the steel sheet S by a ratio of the total number of times of prediction by the non-plating defect prediction models M that there was the non-plating defect in a case where the non-plating defect was detected by the surface inspection device (true positive) and the number of times of prediction by the non-plating defect prediction models M that there was not the non-plating defect in a case where the non-plating defect was not detected by the surface inspection device (true negative) to the total test data.

Evaluation results of the accuracy rate by the non-plating defect prediction models M are illustrated in Table 1 below. Parameters selected as the input variables of the non-plating defect prediction models M are described in Table 1. As the attribute parameter of the steel sheet, a parameter selected from the component composition of the steel sheet S and the dimensional information of the steel sheet S was used. As the operational parameters of the annealing furnace 2, the dew point in the soaking zone, the dew point in the heating zone, the hydrogen concentration, and the carbon monoxide concentration were used as information of atmosphere in the furnace. As the dew points of the soaking zone and the heating zone, average values of the dew points in the respective zones were used. As the hydrogen concentration and the carbon monoxide concentration, measured values of a hydrogen concentration meter and a carbon monoxide concentration meter installed at an exit of the soaking zone were used. As the information of the sheet passing speed, an average speed at which a region in the longitudinal direction to be evaluated of the steel sheet S passes through the annealing furnace 2 was used.

Average values of the gas injected into the soaking zone were used as humidified gas flow rate and a dry gas flow rate which rates are information of the injected gas, and a total flow rate of fuel gas injected into the radiant tube arranged in the heating zone was used as a fuel gas amount. As information of the steel sheet temperature used as the operational parameter of the annealing furnace, a measurement value by a plate thermometer arranged at an exit position of the annealing furnace 2 was used. On the other hand, as the operational parameters of the plating device 3, the dew point in the snout, a steel sheet temperature in the snout, a hydrogen concentration in the snout, a wall surface temperature of the snout, a flow rate of humidified gas supplied into the snout, and a flow rate of dry gas were used as information of the snout condition.

Note that the steel sheet temperature in the snout was considered to be the same as the temperature of the steel sheet entering the plating bath P. For information on the pot condition, a bath temperature of the plating bath, an Al concentration of the plating bath, power supplied to the inductor, and a supplied amount of the ingot I were used. As information of the wiping condition, a target plating adhesion amount to the steel sheet S, injection gas pressure (gas pressure) of the wiping nozzle, a distance between the wiping nozzle and the steel sheet S (nozzle-steel sheet distance), a height of the wiping nozzle from the bath surface (nozzle height), and an injection angle of the wiping gas with respect to the surface of the steel sheet S were used. Then, the non-plating defect prediction models M were generated by utilization of the operational parameters selected from these as input variables, and the accuracy rates with respect to the test data were acquired.

As a result, it was confirmed that the non-plating defect information on the steel sheet S on the exit side of the manufacturing equipment 1 of the hot-dip galvanized steel sheet could be accurately predicted by the non-plating defect prediction model M including, as the input data, one or two or more parameters selected from the attribute parameters of the steel sheet S to be charged into the manufacturing equipment 1 of the hot-dip galvanized steel sheet, one or two or more operational parameters selected from the operational parameters of the annealing furnace 2, and one or two or more operational parameters selected from the operational parameters of the plating device 3. On the other hand, it was confirmed that the accuracy rate of the non-plating defect of the steel sheet S decreases in a case where any parameter of the attribute information of the steel sheet S, the operational parameter of the annealing furnace 2, and the operational parameter of the plating device 3 was not included as the input variable.

TABLE 1

| | Attribute parameter of steel sheet | | Operational parameter of annealing furnace | | | |
|---|---|---|---|---|---|---|
| No. | Component composition (wt %) | Dimensional information | Information of atmosphere in furnace | Information of sheet passing speed | Information of injected gas | Information of steel sheet temperature |
| 1 | Si, Mn | Sheet width | Hydrogen concentration<br>Dew point in soaking zone | — | — | Annealing furnace exit-side sheet temperature |
| 2 | Si, Mn | Sheet width | Hydrogen concentration<br>Dew point in soaking zone | Sheet passing speed | — | Annealing furnace exit-side sheet temperature |
| 3 | Si, Mn | Sheet width | Hydrogen concentration<br>Dew point in soaking zone | — | — | Annealing furnace exit-side sheet temperature |
| 4 | Si, Mn | Sheet width | Hydrogen concentration<br>Dew point in soaking zone | Sheet passing speed | — | Annealing furnace exit-side sheet temperature |
| 5 | Si, Mn | Sheet width | Hydrogen concentration<br>Dew point in soaking zone<br>Dew point in heating zone | Sheet passing speed | — | Annealing furnace exit-side sheet temperature |
| 6 | Si, Mn | Sheet width | Hydrogen concentration<br>Dew point in soaking zone | Sheet passing speed | — | Annealing furnace exit-side sheet temperature |
| 7 | Si, Mn, C, Al, Cr, Mo, Nb, Ti, Cu, Ni, B | Sheet width | Hydrogen concentration<br>Dew point in soaking zone | | — | Annealing furnace exit-side sheet temperature |
| 8 | Si, Mn, C, Al, Cr, Mo, Nb, Ti, Cu, Ni, B | Sheet width | Hydrogen concentration<br>Dew point in soaking zone<br>Dew point in heating zone | | — | Annealing furnace exit-side sheet temperature |
| 9 | Si, Mn | Sheet width | Hydrogen concentration<br>Dew point in soaking zone<br>Carbon monoxide concentration | | — | Annealing furnace exit-side sheet temperature |
| 10 | Si, Mn | Sheet thickness<br>Sheet width | Furnace temperature in soaking zone | Sheet passing speed | Humidified gas flow rate<br>Dry gas flow rate<br>Fuel gas amount | — |
| 11 | Si, Mn | Sheet thickness<br>Sheet width | Furnace temperature in soaking zone | Sheet passing speed | Humidified gas flow rate<br>Dry gas flow rate<br>Fuel gas amount | — |
| 12 | Si, Mn | Sheet thickness<br>Sheet width | Furnace temperature in soaking zone | Sheet passing speed | Humidified gas flow rate<br>Dry gas flow rate<br>Fuel gas amount | — |
| 13 | Si, Mn | Sheet thickness<br>Sheet width | Hydrogen concentration<br>Dew point in soaking zone | | — | Annealing furnace exit-side sheet temperature |
| 14 | Si, Mn | Sheet thickness<br>Sheet width | — | | — | — |
| 15 | — | — | Hydrogen concentration<br>Dew point in soaking zone | | — | Annealing furnace exit-side sheet temperature |

| | Operational parameter of plating device | | | Accuracy rate of non-plating | |
|---|---|---|---|---|---|
| No. | Information of snout condition | Information of pot condition | Information of wiping condition | defect generation | |
| 1 | Dew point | — | | 90.5% | Invention example |

TABLE 1-continued

| | | | | | |
|---|---|---|---|---|---|
| 2 | Dew point | — | Target plating adhesion amount | 92.9% | Invention example |
| 3 | Dew point<br>Steel sheet temperature | — | | 92.2% | Invention example |
| 4 | Dew point<br>Steel sheet temperature | — | Target plating adhesion amount | 94.3% | Invention example |
| 5 | Dew point<br>Steel sheet temperature | — | Gas pressure<br>Nozzle-steel sheet distance<br>Nozzle height<br>Injection angle | 96.2% | Invention example |
| 6 | Dew point<br>Steel sheet temperature | Bath temperature<br>Al concentration | Gas pressure<br>Nozzle-steel sheet distance<br>Nozzle height<br>Injection angle | 95.1% | Invention example |
| 7 | Dew point<br>Steel sheet temperature | | | 94.1% | Invention example |
| 8 | Dew point<br>Steel sheet temperature | Bath temperature,<br>Al concentration<br>Inductor power | Gas pressure<br>Nozzle-steel sheet distance<br>Nozzle height<br>Injection angle | 98.1% | Invention example |
| 9 | Dew point<br>Hydrogen concentration | — | — | 93.0% | Invention example |
| 10 | Wall surface temperature<br>Humidified gas flow rate<br>Dry gas flow rate | Inductor power<br>Ingot supply amount | — | 91.1% | Invention example |
| 11 | Wall surface temperature<br>Humidified gas flow rate<br>Dry gas flow rate | — | Target plating adhesion amount | 93.2% | Invention example |
| 12 | Wall surface temperature<br>Humidified gas flow rate<br>Dry gas flow rate | — | Gas pressure<br>Nozzle-steel sheet distance<br>Nozzle height<br>Injection angle | 95.7% | Invention example |
| 13 | — | — | — | 43.7% | Comparative example |
| 14 | Dew point<br>Hydrogen concentration | — | Gas pressure<br>Nozzle-steel sheet distance<br>Nozzle height<br>Injection angle | 20.2% | Comparative example |
| 15 | Dew point<br>Hydrogen concentration<br>Steel sheet temperature | — | Gas pressure<br>Nozzle-steel sheet distance<br>Nozzle height<br>Injection angle | 24.1% | Comparative example |

Although an embodiment to which the invention made by the present inventors is applied has been described above, the present invention is not limited by the description and drawings included in a part of the disclosure of the present invention according to the present embodiment. That is, other embodiments, examples, operation techniques, and the like made by those skilled in the art on the basis of the present embodiment are all included in the scope of the present invention.

INDUSTRIAL APPLICABILITY

According to the present invention, it is possible to provide the steel-sheet non-plating defect prediction method capable of accurately predicting generation of the non-plating defect of the steel sheet. According to the present invention, it is possible to provide the steel-sheet defect reduction method capable of reducing a generation frequency of the non-plating defect of the steel sheet. In addition, according to the present invention, it is possible to provide the manufacturing method of the hot-dip galvanized steel sheet which method is capable of improving a manufacturing yield of the hot-dip galvanized steel sheet. Furthermore, according to the present invention, it is possible to provide the generation method of the steel-sheet non-plating defect prediction model with which method the non-plating defect prediction model that accurately predicts generation of the non-plating defect of the steel sheet can be generated.

REFERENCE SIGNS LIST

1 MANUFACTURING EQUIPMENT OF HOT-DIP GALVANIZED STEEL SHEET
2 ANNEALING FURNACE
3 PLATING DEVICE
21 HEATING ZONE

22 SOAKING ZONE
23 COOLING ZONE
24*a*, 24*b*, 39 MEASUREMENT DEVICE
31 SNOUT
32 POT
33 WIPING NOZZLE
34 SNOUT HEATER
35, 38 THERMOMETER
36 ONLINE BATH ANALYZE
37 INDUCTOR
100 STEEL-SHEET NON-PLATING DEFECT PREDICTION MODEL GENERATION DEVICE
101 DATABASE
102 MACHINE LEARNING UNIT
110 STEEL-SHEET NON-PLATING DEFECT PREDICTION DEVICE
120 MANUFACTURING EQUIPMENT OPERATING CONDITION SETTING DEVICE
121 OPERATION CONDITION RESETTING UNIT
I INGOT
P HOT-DIP GALVANIZING BATH
S STEEL SHEET

The invention claimed is:

1. A manufacturing method of a hot-dip galvanized steel sheet manufactured in manufacturing equipment of the hot-dip galvanized steel sheet, the manufacturing equipment including an annealing furnace and a plating device arranged on a downstream side of the annealing furnace, wherein the hot-dip galvanized steel sheet uses a high-tensile steel sheet as a base material, the method comprising:

performing a steel-sheet defect reduction that includes:

predicting non-plating defect information of a steel sheet by predicting a steel-sheet non-plating defect by using attribute information of the steel sheet, result values of operational parameters of the annealing furnace, and set values of the operational parameters of the plating device before a tip portion of the steel sheet is charged into the plating device, wherein the predicting the steel-sheet non-plating defect includes predicting steel-sheet non-plating defect information on an exit side of the manufacturing equipment by using a non-plating defect prediction model which is learned by machine learning, the non-plating defect prediction model for which:

an input data is data including one or two or more parameters selected from attribute information of the steel sheet charged into the manufacturing equipment, one or two or more operational parameters selected from operational parameters of the annealing furnace, and one or two or more operational parameters selected from operational parameters of the plating device, and an output data is the non-plating defect information of the steel sheet on the exit side of the manufacturing equipment in order to control an operation of the manufacturing equipment; and resetting the operational parameters of the plating device in such a manner that a non-plating defect generation rate according to the predicted non-plating defect information of the steel sheet is within a preset allowable range; and manufacturing the hot-dip galvanized steel sheet in the manufacturing equipment by using the steel-sheet defect reduction, wherein the plating device is a plating device in which a snout, a plating bath, and a wiping nozzle are arranged in this order from the upstream side, and a temperature of the plating bath and a temperature of the steel sheet entering the plating bath are included as the operational parameters of the plating device which parameters are included in the input data.

2. The method of predicting the steel-sheet non-plating defect according to claim 1, wherein the annealing furnace is a vertical annealing furnace in which a heating zone, a soaking zone, and a cooling zone are arranged in this order from an upstream side, and dew point information of the heating zone and the soaking zone is included as the operational parameter of the annealing furnace which parameter is included in the input data.

3. The method of predicting the steel-sheet non-plating defect according to claim 1, wherein one or two or more operational parameters selected from operational parameters of the wiping nozzle are included as the operational parameters of the plating device which parameters are included in the input data.

4. The method of predicting the steel-sheet non-plating defect according to claim 1, wherein the high-tensile steel sheet contains 0.2 mass % or more of Si.

5. A manufacturing method of a hot-dip galvanized steel sheet manufactured in manufacturing equipment of the hot-dip galvanized steel sheet, the manufacturing equipment including an annealing furnace and a plating device arranged on a downstream side of the annealing furnace, wherein the hot-dip galvanized steel sheet uses a high-tensile steel sheet as a base material, the method comprising:

generating a steel-sheet non-plating defect prediction model that includes:

acquiring a plurality of pieces of learning data in which at least one or two or more pieces of result data selected from attribute information of a steel sheet charged into the manufacturing equipment, one or two or more pieces of operation performance data selected from operational parameters of the annealing furnace, and one or two or more pieces of operational performance data selected from operational parameters of the plating device are input performance data, and non-plating defect information of the steel sheet on an exit side of the manufacturing equipment using the input performance data is output performance data, and generating the non-plating defect prediction model by machine learning using the acquired plurality of pieces of learning data, the non-plating defect prediction model being configured to predict the non-plating defect information of the steel sheet on the exit side of the manufacturing equipment in order to control an operation of the manufacturing equipment; and manufacturing the hot-dip galvanized steel sheet in the manufacturing equipment by using the steel-sheet non-plating defect prediction model, wherein the plating device is a plating device in which a snout, a plating bath, and a wiping nozzle are arranged in this order from the upstream side, and a temperature of the plating bath and a temperature of the steel sheet entering the plating bath are included as the operational parameters of the plating device which parameters are included in the input data.

6. The method of generating steel-sheet non-plating defect prediction model according to claim 5, wherein machine learning selected from a neural network, decision tree learning, random forest, and support vector regression is used as the machine learning.

7. The method of generating the steel-sheet non-plating defect prediction model according to claim 5, wherein the high-tensile steel sheet contains 0.2 mass % or more of Si.

* * * * *